US007243499B2

(12) United States Patent
Cole et al.

(10) Patent No.: US 7,243,499 B2
(45) Date of Patent: Jul. 17, 2007

(54) REFRIGERATION CAPILLARY TUBE INSIDE SUCTION LINE ASSEMBLY

(75) Inventors: Robert G. Cole, Greenfield, TN (US); Michael W. Trumbower, Cromwell, IN (US)

(73) Assignee: Parker Hannifin Corporation, Cleveland, OH (US)

( * ) Notice: Subject to any disclaimer, the term of this patent is extended or adjusted under 35 U.S.C. 154(b) by 193 days.

(21) Appl. No.: 11/204,520

(22) Filed: Aug. 16, 2005

(65) Prior Publication Data

US 2006/0032268 A1 Feb. 16, 2006

Related U.S. Application Data

(60) Provisional application No. 60/601,873, filed on Aug. 16, 2004.

(51) Int. Cl.
*F25B 45/00* (2006.01)
*F25B 41/00* (2006.01)

(52) U.S. Cl. ..... 62/77; 62/513

(58) Field of Classification Search ..... 62/77, 62/79, 498, 511, 513, 527
See application file for complete search history.

(56) References Cited

U.S. PATENT DOCUMENTS

| | | | | |
|---|---|---|---|---|
| 2,133,961 | A | | 10/1938 | Buchanan |
| 2,530,648 | A | | 11/1950 | Cahenzil, Jr. et al. |
| 2,847,835 | A | | 8/1958 | Cooper et al. |
| 3,048,021 | A | * | 8/1962 | Coles et al. ..... 62/51.2 |
| 3,145,545 | A | * | 8/1964 | Jaeger ..... 62/323.4 |
| 4,147,037 | A | | 4/1979 | Gelbard et al. |
| 4,208,887 | A | * | 6/1980 | Morse et al. ..... 62/503 |
| 4,226,606 | A | * | 10/1980 | Yaeger et al. ..... 62/238.6 |
| 5,236,311 | A | * | 8/1993 | Lindstrom ..... 417/254 |
| 5,238,557 | A | * | 8/1993 | Schneider et al. ..... 210/198.2 |
| 5,797,277 | A | * | 8/1998 | Hong et al. ..... 62/285 |
| 6,305,188 | B1 | | 10/2001 | Park |
| 2005/0109486 | A1 | * | 5/2005 | Memory et al. ..... 165/62 |

FOREIGN PATENT DOCUMENTS

| | | | |
|---|---|---|---|
| EP | 167978 | A * | 1/1986 |
| EP | 0 426 061 | | 8/1991 |

* cited by examiner

*Primary Examiner*—Mohammad M. Ali
(74) *Attorney, Agent, or Firm*—Joseph J. Pophal; Daniel J. Whitman; Robert J. Clark

(57) ABSTRACT

A refrigeration capillary tube inside suction tube heat exchanger assembly, including a suction tube whose ends each have a slot with a shaped inner end portion; two braze connectors, each including a sleeve portion with the free end having a shaped recess; a capillary tube adapted to be inserted into one of the suction tube ends and therethrough until each capillary tube ends extends from a suction tube end, each capillary tube end being deformed so as to emerge from the suction tube at locations abutting the shaped inner end portions thereof; and each of the braze connectors sleeve portions engaging one of the suction tube ends, with each suction tube slot cooperating with an adjacent one of the sleeve portion shaped recesses to contact, locate and subsequently fixedly secure the deformed capillary tube portions to the suction tube. Two methods of manufacturing the assembly are also set forth.

20 Claims, 2 Drawing Sheets

REFRIGERATION CAPILLARY TUBE INSIDE SUCTION LINE ASSEMBLY

CROSS REFERENCE TO RELATED APPLICATIONS

The present non-provisional patent application claims the benefit of the filing date of U.S. Provisional Patent Application No. 60/601,873, filed 16 Aug. 2004 the disclosure of which is incorporated herein by reference.

STATEMENT REGARDING FEDERALLY SPONSORED RESEARCH OR DEVELOPMENT

Not Applicable

BACKGROUND OF THE INVENTION

1. Technical Field

The present invention pertains to a Refrigeration Capillary Tube Inside Suction Line Assembly (RCTISLA), which provides improved heat transfer between the cool gaseous refrigerant, conveyed by the suction line, and the warm liquid refrigerant, conveyed by the capillary tube, during the well known refrigeration cycle in a conventional refrigeration system.

2. Description of the Related Art Including Information Disclosed Under 37 CFR 1.97 and 1.98

It is known in the art that placing a capillary tube inside a suction tube or line assembly will result in higher heat transfer as a result of the increased surface area with which the two media, namely the gaseous and liquid refrigerants respectively, are in contact. The present invention permits the noted heat transfer, from the warm liquid refrigerant to the cool gaseous refrigerant, to occur across the complete capillary tube circumference through only the one, single, tubular, wall of a cylindrical capillary tube.

The prior art has addressed both the structure of a RCTISLA and the method of manufacturing such assemblies in the manner set forth in the patent literature, as exemplified by the following: U.S. Pat. No. 2,133,961 to Buchanan; U.S. Pat. No. 2,530,648 to Cahenzli, Jr. et al.; U.S. Pat. No. 2,847,835 to Cooper et al.; U.S. Pat. No. 4,147,037 to Gelbard et al.; U.S. Pat. No. 6,305,188 B1 to Park; and EPO Patent Application No. 0 426 061 A1 to De Nardi.

U.S. Pat. No. 2,133,961 to Buchanan, in FIG. 2 discloses a refrigerant heat exchanger which includes a liquid refrigerant conduit that is located internally of an evaporator conduit. While the liquid refrigerant conduit enters and exits the evaporator conduit, no details are provided as to the structured of the entry and exit portions, how the refrigerant conduit is retained, or how the assembly is manufactured.

U.S. Pat. No. 2,530,648 to Cahenzli, Jr. et al., in FIGS. 1 and 2 discloses a heat exchange device which includes a liquid refrigerant tube entering one end of a casing and exiting at the opposite end. While the refrigerant tube is located within a casing, there is no mention of the mechanism for contacting, locating and fixedly retaining the former relative to the latter.

U.S. Pat. No. 2,847,037 to Cooper et al., discloses a capillary tube inserted in a punched out aperture of a connector tube. It is noted that after insertion thereof, the capillary tube is brazed or welded in place at its point of entry, while the inserted portion thereof rests against the inner peripheral surface of the connector tube. It is specifically set forth that the aperture, required for insertion, be pierced or punched, rather than drilled, in order to provide added material support, such as in the manner of a flange, for the capillary tube. Securing but one end of the inserted capillary tube can lead to vibration and subsequent rattling and can cause problems during subsequent further deformation of the completed assembly that may be required for specific installations. In addition, piercing and punching a tube can easily result in undesired deformation and variable quality.

U.S. Pat. No. 4,147,037 to Gelbard, et al., in FIGS. 2, 5 and 6 discloses, as best seen in FIG. 2, a refrigeration heat exchanger which has a capillary tube passing into and out of the suction tube at connections at 36 and 38, that may be made by soldering or brazing. No details are provided in regard to the specific structures employed at connections 36 and 38, which appear to merely locate and contact the capillary tube, which is physically held in place by longitudinal ridges that are deformed to surround the capillary tube, in the manner shown in FIG. 6 and would appear to detract, by reason of their wall thicknesses, from the heat transfer between the capillary tube and the suction tube.

U.S. Pat. No. 6,305,188 B1 to Park, in FIG. 3 discloses a refrigerant heat exchange device that includes a capillary tube inserted into a connection pipe via opposed T-shaped first and second coupling elements that cooperate to guide the capillary tube in and out of the connection pipe. However, the first coupling elements need to be threaded on to both the connection pipe, as well as separate inlet and outlet pipes, and the second coupling elements additionally require a separate pacing element to leakage of the refrigerant.

EP Patent Application No. 0 426 061 A1 to De Nardi discloses a method of forming a refrigerant heat exchanger tube wherein this heat exchanger tube includes a capillary tube that is inserted thereinto. The heat exchanger tube includes a bent portion where a hole is drilled to enter the capillary tube whose leading end is thereafter passed through the heat exchanger tube and exits at a front end thereof. The capillary entrance hole, after the insertion of the capillary tube, is subsequently welded closed. Thus, the capillary tube has to be inserted through a hole and guided through the heat exchanger tube until it exits from the front end thereof. It is unclear how the tip end of the capillary tube is retained, relative to the heat exchanger tube. The manufacturing method pertains to a completely automated procedure not pertinent to the present invention.

None of the noted prior art structures pertain to the structure of the RCTISLA and the methods of its manufacture, as set forth in the present invention, which features placing a capillary tube inside a suction tube that has opposed, shaped, inner end portions that conjoin with shaped recesses in mating, adjacent female braze connectors, to initially physically contact, locate, and then fixedly secure in a fluid-tight manner, via subsequent brazing the capillary tube relative to the suction tube.

BRIEF SUMMARY OF THE INVENTION

Accordingly, in order to overcome the deficiencies of the noted prior art devices, the present invention provides an improved Refrigeration Capillary Tube Inside Suction Line Assembly (RCTISLA) that is simple, cost effective and permits both a selective entry, as well as a selective exit, of the capillary tube into and from the center suction tube portion, at prescribed locations having a predetermined shape, and, together with female braze connectors, physically contacts, locates and then fixedly secures, in a pressure-tight manner, the capillary tube relative to the suction line assembly.

Specifically, in terms of structure, a refrigeration system utilizes a refrigeration capillary tube inside a suction tube heat exchanger assembly, the assembly comprising in combination: a suction line assembly having; an axial cylindrical center suction tube portion, with an outside diameter and opposed ends, each of the opposed ends having a longitudinal slot of predetermined width, a first predetermined length and a shaped inner end portion; two opposed cylindrical female keyed braze connectors, each having an outer longitudinal tubular main portion and an inner longitudinal, larger diameter integral sleeve portion of a second predetermined length and an inside diameter exceeding the outside diameter of the center suction tube portion, with the free end of each of the sleeve portions having a shaped recess; and axial cylindrical capillary tube, of a predetermined outside diameter, having two ends, the capillary tube being adapted to be deformed, by being bent, so as to emerge from the center suction tube portion at locations abutting the shaped inner end portions of the center suction tube portion; and each of the braze connectors being adapted for a slip-fit engagement of the inner sleeve portion thereof with one of the opposed ends of the center suction tube portions, with each of the shaped inner end portions of the center suction tube portions, with each of the shaped inner end portion of the center suction tube portion longitudinal slots cooperating with an adjacent one of the shaped recesses of the sleeve portions it initially physically contact locate and then fixedly secure in a pressure tight manner, via a subsequent brazing operation, the deformed end portions of the capillary tube relative to the suction line assembly.

In one version, the predetermined outside diameter of the capillary tube is substantially similar to the predetermined width of the slots of the center suction tube portion.

In another version, the inside diameter of the braze connector inner sleeve portions is substantially similar to the outside diameter of the center suction tube portion.

In a further version, the first predetermined length of the slots of the center suction tube portion is substantially similar to the second predetermined length of the inner sleeve portion.

In a differing version, the shapes of the recess portions of each of the sleeve portions and the inner end portions of the center suction tube portion opposed ends are substantially similar. The noted shapes preferably are substantially complementary and semicircular, although they can also be notched.

In yet another version, the physical contacts between the suction line assembly and the capillary tube are substantially continuous and are preferably substantially semicircular.

In a different version, the longitudinal slots, in the opposed ends of the center suction tube portion, are rotationally angularly offset from each other. In addition, the two ends of the capillary tube, emerging from the center suction tube portion, are rotationally angularly offset from each other.

In still another version, the two ends of the capillary tube, emerging from the center section tube portion are one of the same and two different lengths.

In a method of manufacturing a refrigeration capillary tube inside a suction tube heat exchanger assembly, the method comprises the steps of (a) inserting an axial cylindrical capillary tube, having two ends, into one of two opposed ends of an axial cylindrical center suction tube portion, each of the opposed ends having longitudinal slot, with a shaped inner end portion (b) passing the capillary tube through the center suction tube portion until each of the two ends of the capillary tube extends from an opposed end of the center suction tube portion (c) plastically deforming each of the two ends of the capillary tube so as to cause same to emerge from the center suction tube portion at locations abutting the shaped inner end portions of the center suction tube portion (d) locating, in a slip-fit manner, an integral inner tubular sleeve portion of one of two opposed cylindrical female braze connectors, each connector having an outer longitudinal tubular main portion and the inner integral sleeve portion, over an adjacent one of the opposed ends of the center suction tube portion (e) aligning and abutting a shaped recess, located to a free end of each of the sleeve portions, with a cooperating adjacent one of the shaped inner end portions of the center suction tube portion longitudinal slots, so as to physically contact and locate the capillary tube relative to the shaped inner end portions of the opposed ends of the center suction tube portion and the shaped recesses of the abutting female braze connectors, and (f) fixedly securing, in a pressure-tight manner, via a brazing operation, the deformed ends of the capillary tube relative to the center suction tube portion and the female braze connectors, thus completing the assembly.

A variation of the above method further includes (g) further plastically deforming the completed assembly to fit a specific end use application.

In another method of manufacturing a refrigeration capillary tube inside a suction tube heat exchanger assembly, the method comprised the steps of (a) inserting an axial cylindrical capillary tube, having two ends, into one of two opposed ends of an axial cylindrical center suction tube portion, each of the opposed ends having a longitudinal slot, with a shaped inner end portion (b) passing the capillary tube through the center suction tube portion until each of the two ends of the capillary tube extends from an opposed end of the center suction tube portion (c) plastically deforming each of the two ends of the capillary tube so as to cause same to emerge from the center suction tube portion at locations abutting the shaped inner end portions of the center suction tube (d) causing a temporary affixation of at least one of the two plastically deformed ends of the capillary tube with an adjacent one of the opposed ends of the center suction tube portion, thus forming a center suction tube-capillary tube subassembly (e) additionally plastically deforming the subassembly to fit a specific end use application (f) releasing the temporary affixation of the at least one of the two deformed ends of the capillary tube (g) locating, in a slip-fit manner, an integral inner sleeve portion of one of two opposed cylindrical female braze connectors, each connector having an outer longitudinal tubular main portion and the inner integral sleeve portion, over an adjacent one of the opposed ends of the center suction tube portion (h) aligning and abutting a shaped recess, located at a free end of each of the sleeve portions, with a cooperating adjacent one of the shaped inner end portions of the center suction tube portion longitudinal slots, so as to physically contact and locate the capillary tube relative to the shaped inner end portions of the opposed ends of the center suction tube portion and the shaped recesses of the abutting female braze connectors, and (i) fixedly securing, in a pressure-tight manner, via a brazing operation, the deformed ends of the capillary tube relative to the center suction tube portion and the female braze connectors.

A variation thereof, the above-noted method further includes (j) more fully controlling the tension of the capillary tube, during step "e," to minimize any elongation and/or constriction of the capillary tube. Preferably, the more fully controlling the tension of capillary tube, during step "e," includes the step of (k) causing a temporary affixation of each of the two plastically deformed ends of the capillary tube with adjacent ones of the center suction tube portion, thus forming a center suction tube-capillary tube subassembly.

DETAILED DESCRIPTION OF THE INVENTION

Figure 1:
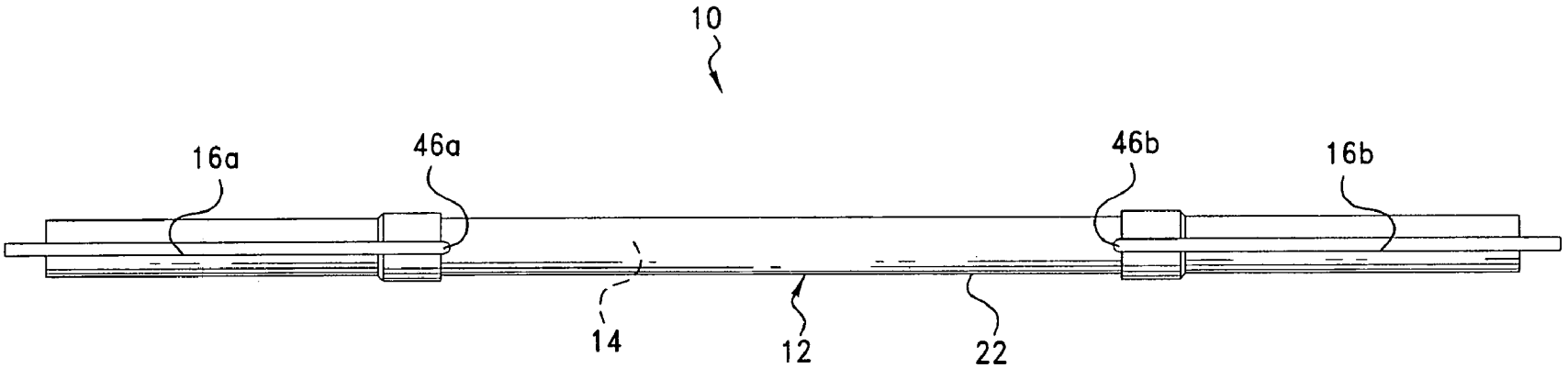
FIG. 1 is a top plan view of the completed refrigeration Capillary Tube Inside Suction Line Assembly (RCTISLA) of this invention.

Referring now to the several drawings, illustrated in FIG. 1 is a completed Refrigeration Capillary Tube Inside Suction Line Assembly (RCTISLA), generally indicated to 10. RCTISLA 10 provides improved heat transfer between a cool gaseous refrigerant 14, conveyed by a suction line or tube assembly 12, to a warm liquid refrigerant 18, conveyed by a capillary tube 16, in a refrigeration system (not shown) in a manner well known in the art. Since the basic refrigeration cycle and apparatus, in which RCTISLA 10 finds utility, are well known, in the interest of brevity, they will not be described herein, particularly since they are set forth in detail in the several, already previously cited, prior art patents.

It is known that placing capillary tube 16 inside suction line or tube assembly 12 will result in higher heat transfer as a result of the increased surface area with which the two noted media are in contact. The present invention permits the noted heat transfer to occur across the complete capillary tube circumference through only one, single, wall of a, preferably copper alloy material, round, cylindrical capillary tube 16.

A Refrigeration Capillary Tube Inside Suction Line Assembly 10 is comprised of capillary tube 16 and suction line or tube assembly 12 which, in turn, includes a preferably copper alloy material, round, cylindrical center suction tube portion 22 and two opposed, preferably copper alloy material, round, cylindrical female keyed braze connectors 24*a*, 24*b*. Center suction tube portion 22 has a longitudinal cut-out or slot 28 with a width 30, substantially similar to the diameter of capillary tube 16 and of a first predetermined length 32 at each of its ends 26. The shaped inner portion 34 of each slot 28 can take any desired configuration but is preferably one of being rounded and of a radius substantially similar to that of capillary tube 16, or a generally V-shaped recess having a predetermined included angle, such as, for example 90 degrees.

Each female keyed braze connector 24*a*, 24*b*, includes a main tubular portion 36 and a larger diameter integral sleeve portion 38, having an inside diameter substantially similar to that of center suction tube portion 22, and having a second predetermined length 40. Each braze connector sleeve portion 38, at the end 42, remote from its intersection with main tubular portion 36, is also provided with a keyed, shaped, small cut-out or recess 44, of any desired configuration, preferably one of being rounded and of a radius substantially similar to that of capillary tube 16, or a generally V-shaped recess having a predetermined included angle, such as, for example 90 degrees.

Figure 2:
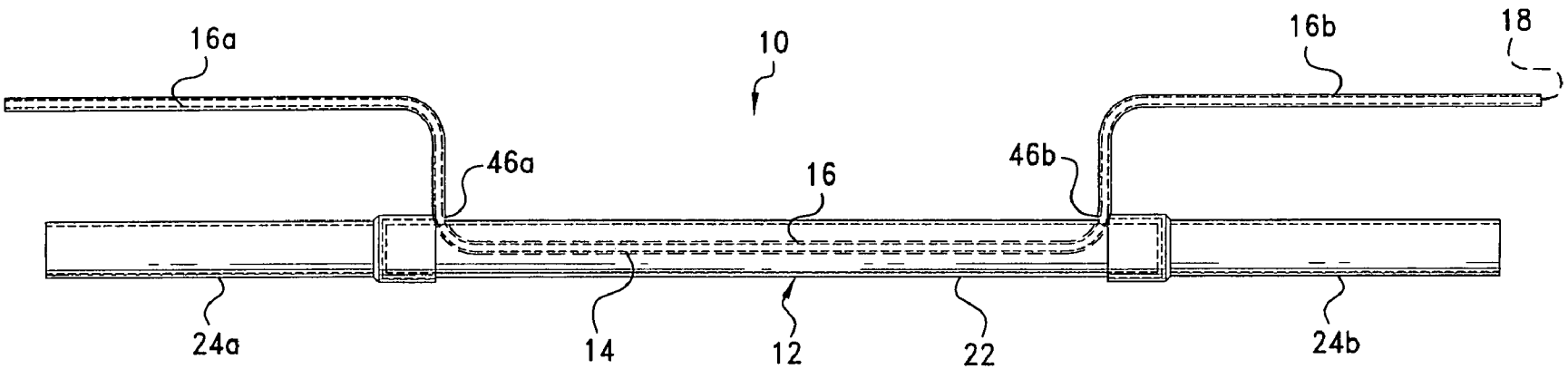
FIG. 2 is a side view of the RCTISLA of FIG. 1.
Figure 3:
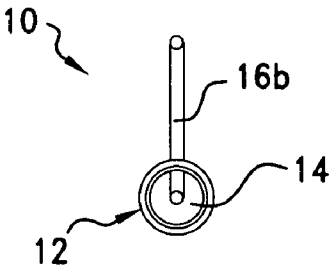
FIG. 3 is a right end view of the RCTISLA of FIG. 2.
Figure 4:
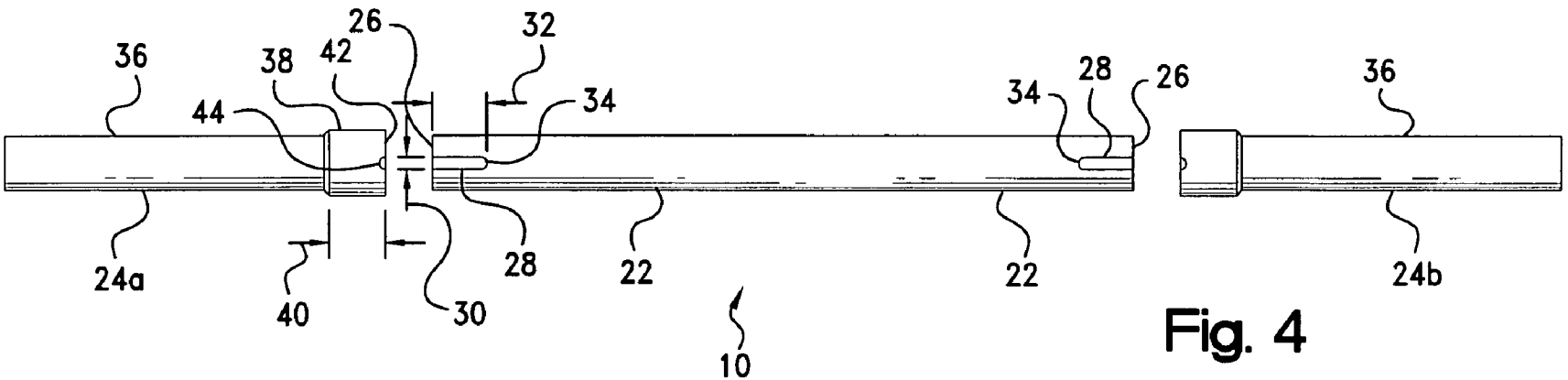
FIG. 4 is an exploded view of the suction line of FIG. 1, showing a centre suction tube and opposed female keyed braze connectors adapted to be joined, to opposite ends of the centre suction tube.

The first predetermined length 32 of each center suction tube slot 28 is substantially similar to that of braze connector sleeve portion 38 and permits a slip-fit mating therebetween and the physical abutment of end surfaces 26 and 42 while providing an aperture or opening, defined by the alignment of center suction tube shaped slot inner portion 34 and braze connector shaped cut-out or recess 44 so as to define or produce opening 46*a*, 46*b*, as best seen in FIGS. 1 and 2, for one of an entrance or exit for capillary tube 16, relative to suction line or tube assembly 12. If slot inner end portion 34 and braze connector recess 44 have radii similar to that of capillary tube 16, upon their alignment, they will make substantially total peripheral contact with the outside diameter of capillary tube 16. If slot inner end portion 34 and braze connector recess 44 are of the noted V-shape, upon their alignment and depending upon their included angles, they will form a diamond, rectangular or square shape whose four sides will make successive tangential contact with the outside diameter of capillary tube 16.

The capillary tube 16—in—center suction tube 22 assembly is performed, in a first embodiment, in the following manner. Straight capillary tube 16 is inserted into and through center suction tube portion 22, with the opposed ends 16*a*, 16*b* thereof being subsequently deformed by being bent up and passed through shaped cut-outs 28 on ends 26 of suction tube portion 22. While deformed capillary tube ends 16*a*, 16*b* are shown as being of equal length, this need not be the case. Female keyed braze connectors 24*a*, 24*b* are then located, in a slip-fit manner, over opposed center suction tube ends 26, thus encapsulating same while providing the noted openings or apertures 46*a*, 46*b* for capillary tube 16 to enter and exit. The shaped, keyed connector cut-outs or recesses 44 are indexed to mate with entering/exiting capillary tube ends 16*a*, 16*b* in cut-outs 34 of suction tube slot ends 28 and provide either fully peripheral or tangential contact, in the manner already previously described, with the outside diameter of capillary tube 16, for the subsequent brazing process. While the drawings show capillary tube ends 16*a*, 16*b*, as residing in a common plane, this need not be the case and apertures 46*a*, 46*b* can be rotationally offset from each other in any desired angular increment, depending on the specific end use configuration. Once keyed connectors 24*a*, 24*b* are installed, they are joined, preferably by brazing or silver soldering, onto center suction tube portion 22, thus sealing, in a pressure-tight manner, both the joints and the entry/exit points of capillary tube ends 16*a*, 16*b*, at apertures 46*a*, 46*b*, respectively. After the brazing process is complete, the now fully assembled RCTISLA 10 may be deformed, such as by bending, as a complete assembly, to fit the specific application. Such a deformation may be necessary since capillary tubes 16 are specified by their inside diameters and overall lengths as calibrated expansion devices in refrigeration systems. Extra length requirement of capillary tube 16 may be taken up via serpentine or helical winding of RCTISLA 10.

In a second embodiment of the assembly method of this invention, the brazing process is performed only after the RCTISLA 10 is deformed or bent to fit the specific application. This second assembly method or process begins with capillary tube 16 being inserted into and through center suction tube section 221. Then, at least one of capillary tube ends 16*a*, 16*b* is temporarily clamped or held fixed in position, in any desired manner, relative to the adjacent center suction tube end 26. The other or free capillary end, either 16*b* or 16*a*, is either also temporarily clamped or can remain free-floating. If the other or free capillary end, 16*b* or 16*a*, is also temporarily clamped, the tension of capillary tube 16 is more fully controlled in a frictional manner during the bending process and minimizes any elongation and/or constriction of capillary tube 16. Constriction of capillary tube 16 will adversely affect the fluid flow characteristics therewithin and the overall operation of at he refrigeration system. Insufficient tension or a "loose" capillary tube 16 may result in capillary tube 16 vibrating or rattling within suction line 12 thereby causing noise and wear problems. After the bending process is complete, the temporary clamping(s) are removed from capillary tube 16 and thereafter, female keyed braze connectors 24*a*, 24*b* are placed over center suction tube ends 26, so as to provide the noted physical peripheral contact with capillary tube 16, and are brazed thereto in the same manner as previously described.

It should be understood at this time that the structured of RCTISLA 10, through being simple and cost effective, permits a selective entry of capillary tube 16 into center suction tube portion 22 at a prescribed location, namely one of slot ends 28 and also permits a selective exit therefrom at the other one of slot ends 28. In addition, there can be selective angular orientation between the entry and exit positions of capillary tube 16 for specific applications. Furthermore, shaped portions 34 and 44 serve to not only contact and locate capillary tube 16, at its entry and exit locations from center suction tube portion 22, but also fixedly retain same after the brazing step or operation. In terms of the assembly methods, they are simple, cost effective, minimize tension on capillary tube 16, and permit subsequent bending or deformation of RCTISLA 10 without damage thereto.

It is deemed that one of ordinary skill in the art will readily recognize that the several embodiments of the present invention fill remaining needs in this art and will be able to affect various changes, substitutions of equivalents and various other aspects of the invention as described herein. Thus, it is intended that the protection granted hereon be limited only by the scope of the appended claims and their equivalents.

What is claimed is:

1. A refrigeration system utilizing a refrigeration capillary tube inside a suction tube heat exchanger assembly, said assembly comprising in combination:

a. a suction line assembly having:

i. an axial cylindrical center suction tube portion, with an outside diameter and opposed ends, each of said opposed ends having a longitudinal slot of a predetermined width, a first predetermined length and a shaped inner end portion;

ii. two opposed cylindrical female brazed connectors, each having an outer longitudinal tubular main portion and an inner longitudinal, larger diameter integral sleeve portion of a second predetermined length and an inside diameter exceeding the outside diameter of said center suction tube portion, with the free end of each of said sleeve portions having a shaped recess;

b. an axial cylindrical capillary tube, of a predetermined outside diameter, having two ends, said capillary tube being adapted to be inserted into one of said opposed ends of said center suction tube portion and therethrough until each of said two ends of said capillary tube extends from an opposed end of said center suction tube portion, each of said two ends being further adapted to be deformed, by being bent, so as to emerge from said center suction tube portion at locations abutting said shaped inner end portions of said center suction tube portion; and c. each of said braze connectors being adapted for a slip-fit engagement of said inner sleeve portion thereof with one of said opposed ends of said center suction tube portions, with each of said shaped inner end portions of said center suction tube portion longitudinal slots cooperating with an adjacent one of said shaped recesses of said sleeve portions to initially physically contact, locate and then fixedly secure in a pressure tight manner, via a subsequent brazing operation, said deformed end portions of said capillary tube relative to said suction line assembly.

2. The refrigeration capillary tube inside a suction tube heat exchanger assembly of claim 1, wherein said predetermined outside diameter of said capillary tube is substantially similar to said predetermined width of said slots of said center suction tube portion.

3. The refrigeration capillary tube inside a suction tube heat exchanger assembly of claim 1, wherein said inside diameter of said braze connector inner sleeve portions is substantially similar to the outside diameter of said center suction tube portion.

4. The refrigeration capillary tube inside a suction tube heat exchanger assembly of claim 1, wherein said first predetermined length of said slots of said center suction tube portion is substantially similar to said second predetermined length of said inner sleeve portion.

5. The refrigeration capillary tube inside a suction tube heat exchanger assembly of claim 1, wherein said shapes of said recess portions of each of said sleeve portions and said inner end portions of said center suction tube portion opposed ends are substantially similar.

6. The refrigeration capillary tube inside a suction tube heat exchanger assembly of claim 5, wherein said shapes are substantially complementary.

7. The refrigeration capillary tube inside a suction tube heat exchanger assembly of claim 5, wherein said shapes are semicircular.

8. The refrigeration capillary tube inside a suction tube heat exchanger assembly of claim 5, wherein said shapes are notched.

9. The refrigeration capillary tube inside a suction tube heat exchanger assembly of claim 1, wherein said physical contacts between said suction line assembly and said capillary tube are substantially continuous.

10. The refrigeration capillary tube inside a suction tube heat exchanger assembly of claim 1, wherein said physical contacts between said suction line assembly and said capillary tube are substantially semicircular.

11. The refrigeration capillary tube inside a suction tube heat exchanger assembly of claim 1, wherein said physical contacts between said suction line assembly and said capillary tube are intermittent.

12. The refrigeration capillary tube inside a suction tube heat exchanger assembly of claim 1, wherein said physical contacts between said suction line assembly and said capillary tube are substantially tangential.

13. The refrigeration capillary tube inside a suction tube heat exchanger assembly of claim 1, wherein said longitudinal slots, in said opposed ends of said center suction tube portion, are rotationally angularly offset from each other.

14. The refrigeration capillary tube inside a suction tube heat exchanger assembly of claim 13, wherein said two ends of said capillary tube, emerging from said center suction tube portion, are rotationally angularly offset from each other.

15. A heat exchanger assembly comprising:

a refrigeration capillary tube; and a suction line assembly comprising a center portion and first and second connector portions, said center portion having opposite first and second ends, a first cut-out extending into said first end of said center portion and a second cut-out extending into said second end of said center portion, said first connector portion including an end portion for attaching to said first end of said center portion, a third cut-out extending into said end portion of said first connector portion, said first and third cut-outs, when said first connector portion is attached to said first end of said center portion, collectively forming a first aperture through which the refrigeration capillary tube enters said suction line assembly, said second connector portion including an end portion for attaching to said second end of said center portion, a fourth cut-out extending into said end portion of said second connector portion, said second and fourth cut-outs, when said second connector portion is attached to said second end of said center portion, collectively forming a second aperture through which the refrigeration capillary tube exits said suction line assembly, said refrigeration capillary tube extending through said center portion of said suction line assembly between said first and second apertures.

16. A method of manufacturing a refrigeration capillary tube inside a suction tube heat exchanger assembly, said method comprising the steps of:

a. inserting an axial cylindrical capillary tube, having two ends, into one of two opposed ends of an axial cylindrical center suction tube portion, each of said opposed ends having a longitudinal slot, with a shaped inner end portion;

b. passing said capillary tube through said center suction tube portion until each of said capillary tube extends from an opposed end of said center suction tube portion;

c. plastically deforming each of said two ends of said capillary tube so as to cause same to emerge from said center suction tube portion at locations abutting said shaped inner end portions of said center suction tube portion;

d. locating in a slip-fit manner, an integral inner tubular sleeve portion of one of two opposed cylindrical female braze connectors, each connector having an outer longitudinal tubular main portion and said inner integral sleeve portion, over an adjacent tone of said opposed ends of said center suction tube portion;

e. aligning and abutting a shaped recess, located at a free end of each of said sleeve portions, with a cooperating adjacent tone of said shaped inner end portions of said center suction tube portion longitudinal slots, so as to physically contact and locate said capillary tube relative to said shaped inner end portions of said opposed ends of said center suction tube portion and said shaped recesses of said abutting female braze connectors; and f. fixedly securing, in a pressure-tight manner, via a brazing operation, said deformed ends of said capillary tube relative to said center suction tube portion and said female braze connectors, thus completing said assembly.

17. The method of manufacturing a refrigeration capillary tube inside a suction tube heat exchange assembly of claim 16, said method further including:

g. further plastically deforming said completed assembly to fit a specific end use application.

18. A method of manufacturing a refrigeration capillary tube inside a suction tube heat exchanger assembly, said method comprising the steps of:

a. inserting an axial cylindrical capillary tube, having two ends, into one of two opposed ends of an axial cylindrical center suction tube portion, each of said opposed ends having a longitudinal slot, with a shaped inner end portion;

b. passing said capillary tube through said center suction tube portion until each of said two ends of said capillary tube extends form an opposed end of said center suction tube portion;

c. plastically deforming each of said two ends of said capillary tube so as to cause same to emerge form said center suction tube portion at locations abutting said shaped inner end portions of said center suction tube;

d. causing a temporary affixation of at least one of said two plastically deformed ends of said capillary tube with an adjacent one of said opposed ends of said center suction tube portion, thus forming a center suction tube-capillary tube subassembly;

e. additionally plastically deforming said subassembly to fit a specific end use application;

f. releasing said temporary affixation of said at least one of said two deformed ends of said capillary tube;

g. locating in a slip-fit manner, an integral inner sleeve portion of one of two opposed cylindrical female braze connectors, each connector having an outer longitudinal tubular main portion and said inner integral sleeve portion, over an adjacent one of said opposed ends of said center suction tube portion;

h. aligning and abutting a shaped recess, located at a free end of each of said sleeve portions, with a cooperating adjacent one of said shaped inner end portions of said center suction tube portion longitudinal slots, so as to physically contact and locate said capillary tube relative to said shaped inner end portions of said opposed ends of said center suction tube portion and said shaped recesses of said abutting female braze connectors; and i. fixedly securing in a pressure-tight manner, via a brazing operation, said deformed ends of said capillary tube relative to said center suction tube portion and said female braze connectors.

19. The method of manufacturing a refrigeration capillary tube inside a suction tube heat exchanger assembly of claim 18, said method further including:

j. more fully controlling the tension of said capillary tube, during step e, to minimize any elongation and/or constriction of said capillary tube.

20. The method of manufacturing a refrigeration capillary tube inside a suction tube heat exchanger assembly of claim 19, wherein said more fully controlling the tension of capillary tube, during step e, includes the step of:

k. causing a temporary affixation of each of said two plastically deformed ends of said capillary tube with adjacent ones of said center suction tube portion, thus forming a center suction tube-capillary tube subassembly.

* * * * *